US005226604A

United States Patent [19]

Seiffert et al.

[11] Patent Number: 5,226,604

[45] Date of Patent: Jul. 13, 1993

[54] METHOD OF AND APPARATUS FOR ADJUSTING COMMINUTING MACHINES

[75] Inventors: Klaus-Peter Seiffert, Lienen; Hiep P. Hung, Münster, both of Fed. Rep. of Germany

[73] Assignee: Salzgitter Maschinenbau GmbH, Salzgitter, Fed. Rep. of Germany

[21] Appl. No.: 808,645

[22] Filed: Dec. 17, 1991

Related U.S. Application Data

[63] Continuation-in-part of Ser. No. 506,694, Apr. 9, 1990.

[30] Foreign Application Priority Data

Apr. 7, 1989 [DE] Fed. Rep. of Germany ..... 3911271

[51] Int. Cl.[5] ..... B02C 13/09; B02C 13/31

[52] U.S. Cl. ..... 241/30; 241/34; 241/37; 241/189.1; 241/290

[58] Field of Search ..... 241/30, 34, 37, 189.1, 241/290

[56] References Cited

U.S. PATENT DOCUMENTS

| | | | |
|---|---|---|---|
| 2,136,907 | 11/1938 | Roder . | |
| 2,405,059 | 7/1946 | Sahmel | 241/101.3 X |
| 2,440,927 | 5/1948 | Boss et al. | 241/101.3 X |
| 3,035,782 | 5/1962 | Burbank . | |
| 3,314,614 | 4/1967 | Daniel et al. | 241/34 X |
| 3,716,196 | 2/1973 | Motek et al. | 241/33 X |
| 3,996,452 | 12/1976 | Schulze et al. | 241/34 X |
| 4,084,752 | 4/1978 | Hagiwara et al. | 241/30 |
| 4,597,535 | 7/1986 | Fontanille | 241/34 X |
| 4,611,763 | 9/1986 | Tomiyasu et al. | 241/30 |

FOREIGN PATENT DOCUMENTS

| | | |
|---|---|---|
| 19541 | 11/1982 | European Pat. Off. . |
| 0177833 | 12/1986 | European Pat. Off. . |
| 2018496 | 10/1971 | Fed. Rep. of Germany . |
| 2034672 | 1/1972 | Fed. Rep. of Germany . |
| 3525101 | 1/1987 | Fed. Rep. of Germany . |
| 1183768 | 7/1959 | France . |

OTHER PUBLICATIONS

"Aufbereitungs-Technik" 1975 vol. 8.

*Primary Examiner*—Mark Rosenbaum
*Assistant Examiner*—Frances Chin
*Attorney, Agent, or Firm*—Horst M. Kasper

[57] ABSTRACT

The width of the clearance between a rotor with orbiting beaters and a pivotable impact plate of a machine for comminuting coal, rock, and like materials is adjusted by a computer which controls a reversible motor serving to pivot the impact plate relative to the path of orbital movement of the beaters. The computer causes the plate to pivot toward the path of the beaters when it receives a signal that the admission of material into the housing of the comminuting machine is interrupted and a converted acoustic signal denoting that the machine generates sounds which are indicative of completed evacuation of material from the housing. The direction of pivotal movement of the plate is reversed when the computer receives a series of converted acoustic signals or a single converted acoustic signal denoting that the width of the clearance has been reduced to zero, i.e., that the beaters actually strike the adjacent portion of the plate. The computer arrests the motor when the width of the clearance reaches a preselected value and the computer thereupon initiates renewed admission of material into the housing.

45 Claims, 3 Drawing Sheets

10
11
17
28
12
15
16
13
6
5
1
14
7a

METHOD OF AND APPARATUS FOR ADJUSTING COMMINUTING MACHINES

CROSS-REFERENCE TO RELATED APPLICATIONS

This application is a continuation-in-part application of another application filed Apr. 9, 1990 and bearing Ser. No. 07/506,694. The entire disclosure of this latter application, including the drawings thereof, is hereby incorporated in this application as if fully set forth herein.

BACKGROUND OF THE INVENTION

1. Field of the Invention

The present invention relates to improvements in comminuting machines for coal, rocks, stones and the like, and more particularly to improvements in comminuting machines, such as impact wherein the width of the clearance between at least one first and at least one second comminuting or crushing tool is variable to permit selection of the size of comminuted material and/or to compensate for wear upon the parts of the comminuting tools. The invention also relates to a method of operating a comminuting machine of the above outlined character.

2. Brief Description of the Background of the Invention Including Prior Art

A comminuting machine normally comprises at least one first comminuting tool, e.g., a rotor with one or more material crushing or comminuting components called beaters and constituting or including plates, vanes or like parts, a drive which moves the beaters of the first tool along a predetermined path, e.g., along an endless path, at least one second tool, e.g., in the form of a pivotable or otherwise movable impact plate, and means for moving the second tool relative to the first tool in order to vary the width of the clearance between the two paths, i.e., to select the maximum size of comminuted particles of material which is being admitted into the inlet or inlets of the housing for the first and second tools. It is customary to adjust the position of the second tool relative to the first tool at certain intervals in order to compensate for wear upon the beaters and/or upon the impact plate, i.e., in order to compensate for an undesirable increase of the width of the clearance.

In accordance with a prior proposal, the means for moving the second tool relative to the first tool are actuated to move the impact plate toward the path of movement of the beaters whereby the beaters strike the impact plate with attendant generation of sound or noise having a certain intensity. Such noise or sound is monitored by a microphone which generates signals denoting the development of sound as a result of impingement of beaters upon the second tool. These signals enable an operator to reverse the direction of movement of the second tool, namely in a direction away from the first tool, until the width of the clearance reaches a desired value. Such procedure of correcting the width of the clearance at certain intervals can be resorted to in connection with impact crushers, and analogous comminuting machines. Intermittent adjustments of the width of the clearance are necessary because the wear upon the components of the first and second tools is, or can be, pronounced whereas the users of comminuting machines strive to produce comminuted rocks, coal or other materials having a predetermined maximum particle size. As a rule, or at least in many instances, the comminuting component or components of the second tool are pivotable toward and away from the path of movement of beaters forming part of the first tool. This holds true irrespective of whether the machine is an impact crusher with or without a grinding track which is located downstream of the clearance between the first and second tools.

The procedure to alter the width of the clearance between the first and second tools in a conventional comminuting machine is a time-consuming chore which invariably involves substantial losses in output. Thus, it is normally necessary to arrest the machine and to open the housing for the tools in order to afford access to the clearance which is then measured in order to ascertain whether or not the wear upon the components of the tools is sufficient to warrant an adjustment of the clearance. As mentioned above, the wear upon the components of the tools which define the clearance is often quite pronounced so that the machine must be arrested at rather frequent intervals.

The published German Patent Application No. 2,018,496 proposes to avoid stoppage of the comminuting machine for the sole purpose of altering the width of the clearance between the first and second tools. This is to be achieved by employing a contact-free proximity detector which is intended to prevent movements of the second tool into actual contact with the beaters of the first tool. It has been found that such proposal is unsatisfactory and, therefore, the machine which is disclosed in the published patent application No. 2,018,496 failed to gain acceptance in the industry.

Another proposal to avoid stoppage of the comminuting machine for the express purpose of altering the width of the clearance is disclosed in published German patent application No. 2,034,672. This publication suggests to carry out a number of experiments with different types of materials which are to be comminuted and to ascertain the anticipated wear upon the components of the first and second tools when the machine is in use to comminute a particular material. The results of such experiments are to be utilized for intermittent adjustment of the second tool by moving it toward the first tool in order to compensate for anticipated wear. The adjustment of the width of the clearance can be carried out continuously or in stepwise fashion. The operation of such machines is unreliable because it is difficult to ascertain, in advance, the exact composition, including the hardness and the size, of a material which is to be comminuted. Moreover, proper reliance on the just discussed procedure necessitates the carrying out of extensive experiments and the utilization of rather complex controls for the mechanism which serves to move the second tool relative to the first tool.

In accordance with the aforediscussed first prior proposal, the admission of material into the housing of the comminuting machine is interrupted and the second tool is slowly moved toward the first tool until it is actually struck by the beaters of the first tool. This results in the generation of pronounced noise which is ascertained with a microphone. The movement of the second tool toward the first tool is then interrupted and the direction of movement of the second tool is reversed until the width of the clearance is increased to a desired value. A machine of the just described character is described and shown in the German-language publication entitled "Aufbereitungstechnik". Reference may be had to FIG. 7 and to the article entitled "Hartzerkleinerungsmaschinen für neue Verfahrenstechniken" (1975, Volume 8). The same machine is described in the servicing manual which was first published Dec. 12, 1974 and refers to an impact crusher which was distributed by HAZEMAG Dr. E. Andreas GmbH & Co., Münster, Federal Republic Germany. All necessary manipulations including starting the means for moving the second tool in a direction toward the first tool, reversing the direction of movement of the second tool when the microphone furnishes signals denoting that the beaters of the first tool strike the second tool, and arresting the moving means for the second tool are carried out by hand. A somewhat similar machine is disclosed in U.S. Pat. No. 3,035,782.

A drawback of the HAZEMAG machine and of the machine which is described in U.S. Pat. No. 3,035,782 is that the operator must be on the alert to immediately reverse the direction of movement of the second tool when the microphone generates a signal denoting that the second tool is being struck by the beaters of the first tool. This requires much concentration on the part of the attendant, and the operator must be able to react quickly in order to avoid prolonged interruptions of operation and potential extensive damage to the parts of the comminuting machine.

SUMMARY OF THE INVENTION

1. Purposes of the Invention

It is an object of the present invention to provide a method which renders it possible to select the width of the clearance between the tools of a comminuting machine within a fraction of the time which is required to complete such operation in accordance with heretofore known methods.

It is a further object of the invention to provide a fully automatic method which can be practiced in such a way that lack of skill and/or lack of attentiveness or concentration on the part of the operator(s) does not affect the quality of adjustment of the width of the clearance.

It is yet a further object of the invention to provide a method which renders it possible to properly select the width of the clearance irrespective of the presence or absence of one or more attendants.

It is still a further object of the invention to provide a method which renders it possible to properly select the width of the clearance between the tools of an impact crusher, or any other comminuting machine with minimal interruptions of operation of the machine and by full consideration of all important parameters including the desired size of comminuted material, the hardness of the material to be comminuted, and the extent of wear upon the material contacting and/or other parts of the machine.

Still another object of the invention is to provide a novel and improved comminuting machine which can be utilized for the practice of the above outlined method.

Yet another object of the invention is to provide the comminuting machine with novel and improved means for rapidly, automatically and accurately selecting the width of the clearance wherein the material is comminuted on its way between two or more cooperating comminuting or crushing tools.

An additional object of the invention is to provide the machine with novel and improved means for controlling the movements of one or more comminuting tools relative to the other comminuting tool or tools.

A further object of the invention is to provide the machine with novel and improved means for moving one of the comminuting or crushing tools relative to another comminuting or crushing tool in an impact crusher, or in a like comminuting machine.

Another object of the invention is to provide novel and improved means for automatically compensating for wear of the tools comminuting a material in the above outlined machine.

A further object of the invention is to provide the machine with novel and improved means for initiating the restarting of material admission upon completion of adjustment of the width of the clearance wherein the material is being comminuted on its way from the inlet to the outlet of the machine.

These and other objects and advantages of the present invention will become evident from the description which follows.

2. Brief Description of the Invention

One feature of the present invention resides in the provision of a method of operating a comminuting machine for stones, coal, rocks and like materials, particularly an impact crusher, wherein a driven first tool carries beaters which advance along a predetermined path adjacent a mobile second tool to define with the second tool a clearance or gap relative to the first tool, which gap determines the particle size of the comminuted material as a result of admission and passing through the machine. The method comprises the steps of interrupting the admission of material into the machine, moving the second tool toward the path of the beaters in automatic response to the interrupting step but with a delay which suffices to complete the evacuation of comminuted material from the machine so that the beaters strike the second tool with attendant generation of sound having a predetermined intensity, and automatically retracting the second tool from the path in response to the generation of such sound to establish a clearance having a predetermined width.

In an absence of material the machine produces a second sound (no load running sound) having a second intensity less than the predetermined intensity. The moving step can further comprise monitoring the sound, generating a signal when the intensity of monitored sound surpasses the second intensity and utilizing the signal to terminate the aforementioned delay.

The comminuting machine can constitute an impact crusher wherein the first tool is or includes a rotor which orbits its beaters along an endless path. The method of operating such impact crusher can further comprise the step of repeating the interrupting, moving and retracting steps at intervals to compensate for wear upon the tools.

The beaters strike the second tool at predetermined intervals where the duration of the intervals is a function of the speed of advancement of the beaters along the predetermined path with attendant generation of a series of sounds having the predetermined intensity. Such method preferably further comprises the steps of monitoring the intensity and frequency of sounds and generating signals when the intensity of sounds corresponds to the predetermined intensity (i.e., when the beaters strike the second tool), interrupting the moving step in response to the first signal, resuming the moving step when the interval between the first signal and the next-following signal is longer than one of the predetermined intervals, and starting the retracting step in response to the generation of a predetermined number of signals at the predetermined intervals, i.e., when it is clear that the second tool is located in the path of and is struck by successive beaters of the first tool. Alternatively, the retracting step can be started in response to the generation of a predetermined number of signals at the predetermined frequency.

The interrupting, moving and retracting steps, occurring in an impact crusher or in another comminuting machine, can be repeated at intervals which depend upon the nature of the material to be comminuted, i.e., on anticipated wear upon the first and second tools.

The method can further comprise the step of terminating the retracting step, i.e., of selecting the width of the clearance, in dependency upon the desired size of comminuted material.

As mentioned above, in the absence of material the machine generates a second sound having a second intensity which is less than the predetermined intensity. The method comprises the steps of monitoring the sounds which are generated by the second and/or first tool. While the machine is running, there are generated sounds having the second intensity. First signals are generated in response to a detection of sounds having the predetermined intensity. The first signals are utilized to interrupt the moving step, and the second signals are utilized to terminate the aforementioned delay.

The comminuting machine is or can be designed in such a way that the second tool is yieldable to assume an inoperative position. An inoperative position is a position at an excessive distance from the path of beaters of the first tool. The clearance can be increased in response to admission of a material having a predetermined hardness. Such a material having a predetermined hardness can be a material, where the material would be likely to damage the beaters and/or the second tool if the second tool were not free to yield during passage of such material through the clearance. The method can further comprise the steps of monitoring the position of the second tool and blocking the moving step. This means that the second tool will be prevented from moving toward the path of the beaters when the second tool reaches an inoperative position.

Another feature of the present invention resides in the provision of a comminuting machine, particularly an impact crusher with a housing having an inlet for material. The material to be comminuted in the machine can be pieces of rock or stone. A first tool is movably mounted in the housing and has a plurality of beaters. A drive means is connected to the first tool and serves to move the beaters in the housing along a predetermined path. A second tool is movably mounted in the housing adjacent the path and defines together with the first tool a clearance. A moving means is operable to move the second tool relative to the first tool and thereby varies the width of the clearance. Means for generating first signals represents the intensity of sound generated by the machine in an absence of material providing a no load running sound. Means for generating second signals represents the intensity of sounds which are generated when the width of the clearance is zero so that the beaters strike the second tool. Automatic control means includes means for generating third signals in response to admission of material into the inlet of the housing. Means for operating the moving means in response to the first and third signals to reduce the width of the clearance and thereupon in response to the second signals to increase the width of the clearance to predetermined value can be a computer.

The means for generating first signals, the means for generating second signals and the means for generating third signals can comprise a common microphone having an output for delivering electric signals representing the intensity of monitored sounds. An amplifying means is provided for amplifying the electric signals delivered by, for example, the microphone. A first threshold circuit is connected to the amplifying means and has an output for first signals connected to the operating means. A second threshold circuit is connected to the amplifying means and has an output for second signals connected to the operating means. Such machine can further comprise time delay means connected between the output of at least one of the first and second threshold circuits and the operating means.

The operating means can be designed to effect a movement of the second tool away from the first tool in response to reception of a predetermined number of third signals and/or to initiate resumption of admission of material into the inlet in response to a widening of the clearance to a predetermined value.

The second tool can include a so-called impact plate and a cushion which yields to permit the impact plate to move to an inoperative position disposed at a greater distance from the path of movement of the beaters in response to penetration into the clearance of a material having a predetermined and/or excessive hardness. The control means then preferably further comprises means for monitoring the position of the plate and for preventing operation of the moving means in a direction to reduce the width of the clearance in the inoperative position of the plate.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
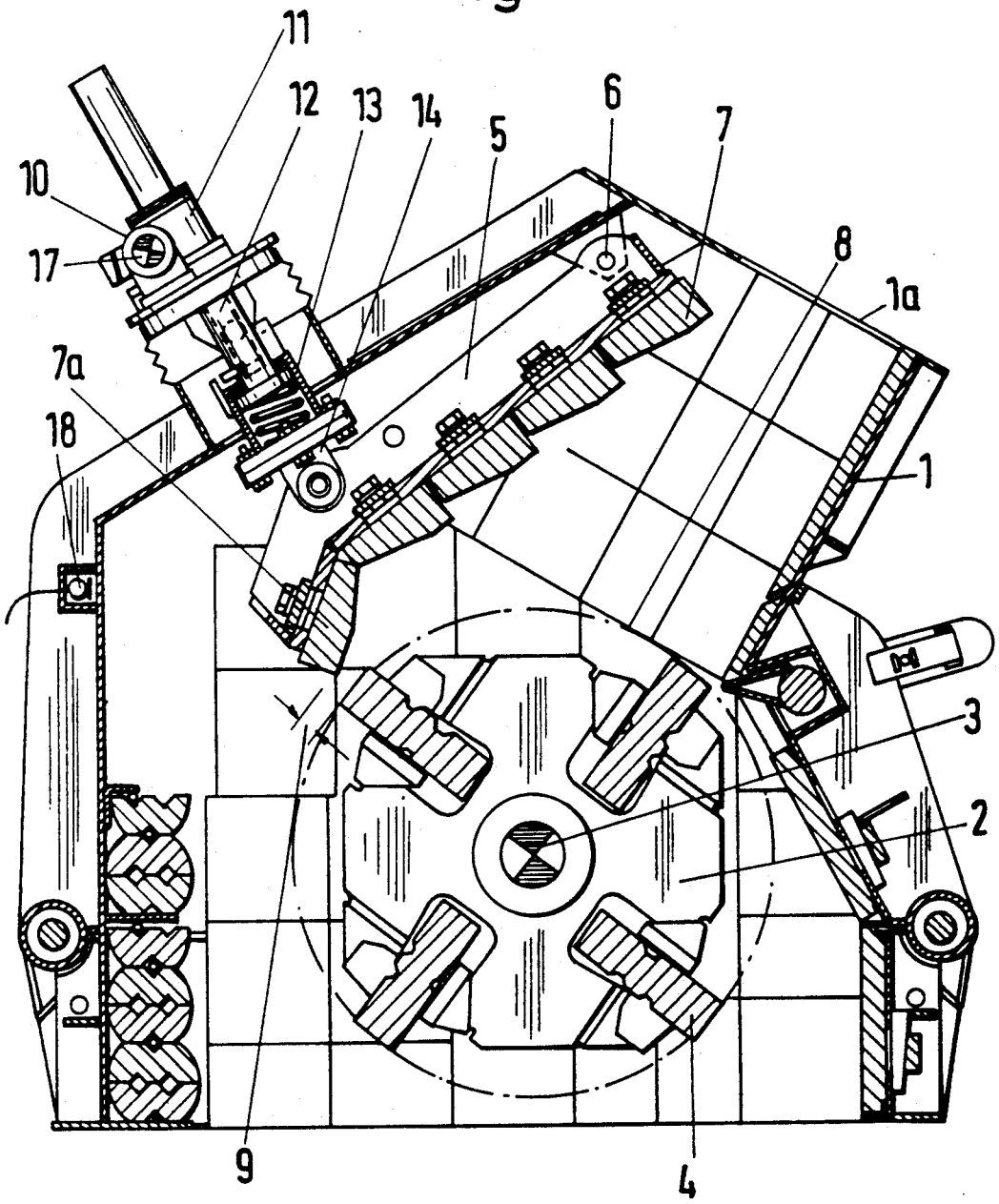
FIG. 1 is a fragmentary central vertical sectional view of a comminuting machine which embodies one form of the invention, where a second tool is spaced apart from the path of movement of beaters which form part of a first tool.

FIG. 1 shows a portion of a comminuting machine which is an impact crusher having a housing 1 with an inlet la for admission of material to be comminuted. The material can be rock, stone or coal. The housing 1 accommodates a first comminuting tool 2 which includes a rotor turntable about the axis of a horizontal shaft 3. The rotor has attached a set of four equidistant comminuting or crushing components in the form of substantially radially extending vanes 4. The comminuting or crushing components are hereinafter called beaters. The shaft 3 forms part of a drive means which rotates the rotor of the first tool 2 in a counterclockwise direction whereby the beaters 4 orbit along an endless circular path 8.

The housing 1 further accommodates a second movable tool 5 including a comminuting component 7 in the form of a so-called impact plate having a lower end portion *7a* adjacent the path of movement of the beaters 4 and defining with the rotor of the first tool 2 a clearance or gap 9. The tool 5 is pivotable relative to the housing 1 about the axis of a horizontal pivot member 6, which member is disposed parallel to the shaft 3 and enables the lower end portion *7a* of the plate 7 to widen or narrow the clearance 9, depending upon the direction of pivotal movement of the second tool 5.

The means for moving the tool 5 relative to the housing 1 and first tool 2, i.e., for altering the width of the clearance 9, includes a reversible electric motor 10, a worm drive 11, a feed screw 12, an elastic insert or cushion 13, and a lug 14. The worm drive 11 receives motion from and is driven by an output element of the motor 10. The feed screw 12 is disposed substantially radially relative to the axis of the rotor of the first tool 2 and is driven by the worm drive 11. The connection member or lug 14 connects the elastic intermediate member or elastic insert or cushion 13 (FIG. 3) with the base of the plate 7.

The purpose of the cushion 13 is to yield and to enable the plate 7 to move to a retracted or inoperative position when the clearance 9 receives one or more pieces or fragments of a material having a predetermined hardness such that the plate 7 and/or the beaters 4 and/or the drive, including the shaft 3, for the rotor of the first tool 2 and/or the means for mounting the tool 5 in the housing 1 would likely be damaged or destroyed if at least one of the tools were unable to yield when such material advances toward and through the clearance 9.

Figure 2:
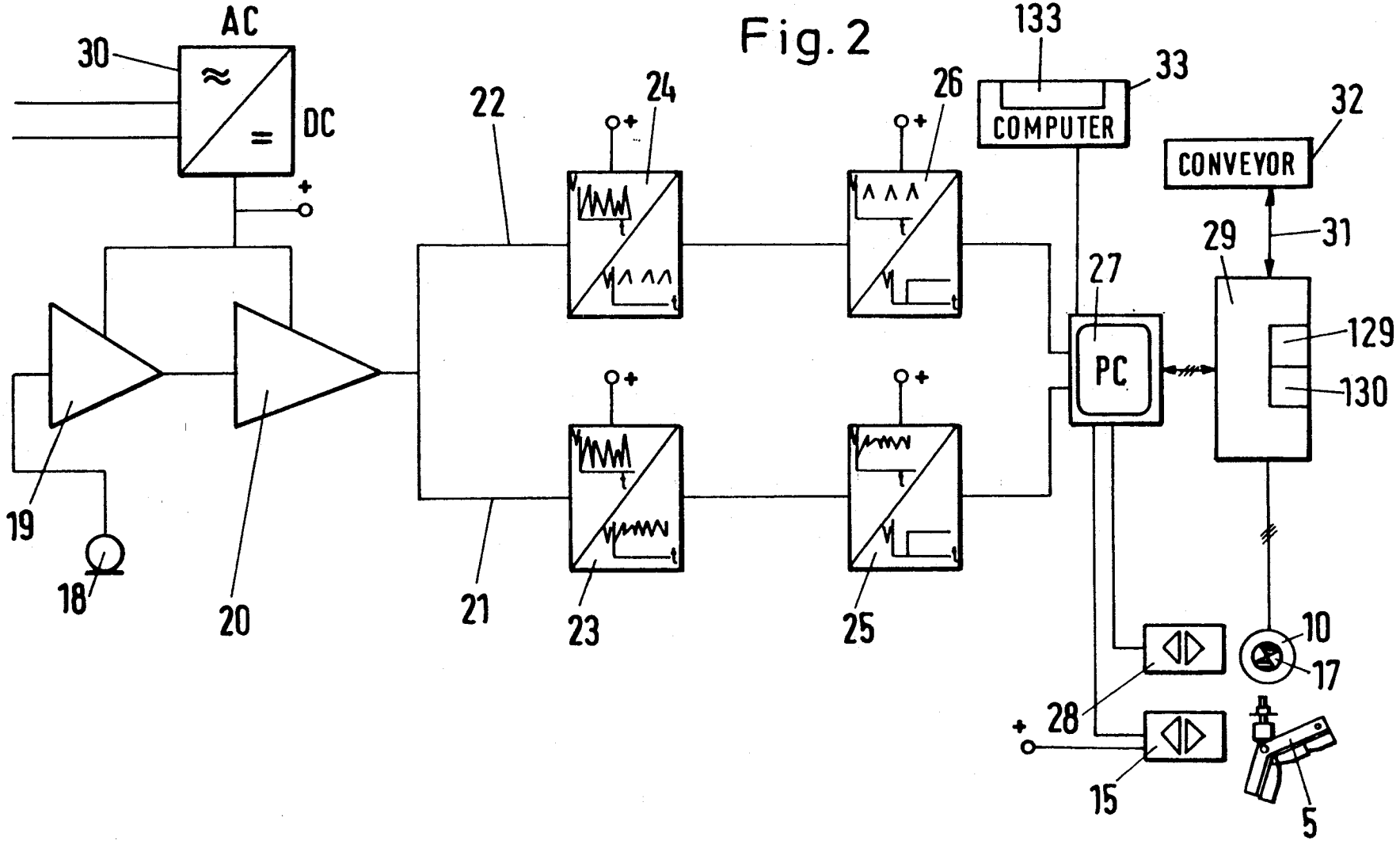
FIG. 2 is a circuit diagram of a control apparatus for use in the machine of FIG. 1 to control the means for moving the second tool with reference to the first tool.

The comminuting machine of FIG. 1 further comprises means for monitoring the position of the second tool 5 relative to the first tool 2 and for generating a signal when the tool 5 is caused to assume its inoperative or retracted position in order to prevent damage to the machine, i.e., to permit one or more fragments of a relatively hard material or of an extremely hard material to pass through the clearance 9 without undergoing any or without undergoing a full comminuting action. The monitoring means comprises a switch or a like signal generating element 15 on or in the housing 1 of the comminuting machine, and an actuator 16 which is mounted for movement with the cushion 13 and actuates the switch 15 so that the latter generates a signal when the cushion is compelled to yield in response to movement of the tool 5 to the inoperative position, i.e., to a position at a greater than selected or desired distance from the path 8 of orbital movement of the beaters 4. The cushion 13 can yield in response to penetration of relatively hard material into the clearance 9 and remains in compressed condition in response to jamming of the second tool 5 relative to the housing 1 in a position at a greater than desired distance from the path 8. The switch 15 can transmit a signal to a computer 27 which is shown in FIG. 2 and to a source of visible, audible and/or otherwise detectable signals which inform the persons in charge that the second tool 5 has been caused to assume and dwells in its inoperative position. The computer 27 provides operating means for the moving means including the motor 10. It is clear that the illustrated switch 15 and the actuating means 16 therefore can be replaced with any other monitoring means which is capable of transmitting appropriate signals to the computer 27 and/or to a source of detectable signals. Such source can receive signals from the switch 15 or from another position monitoring means by way of the computer 27.

Figure 3:
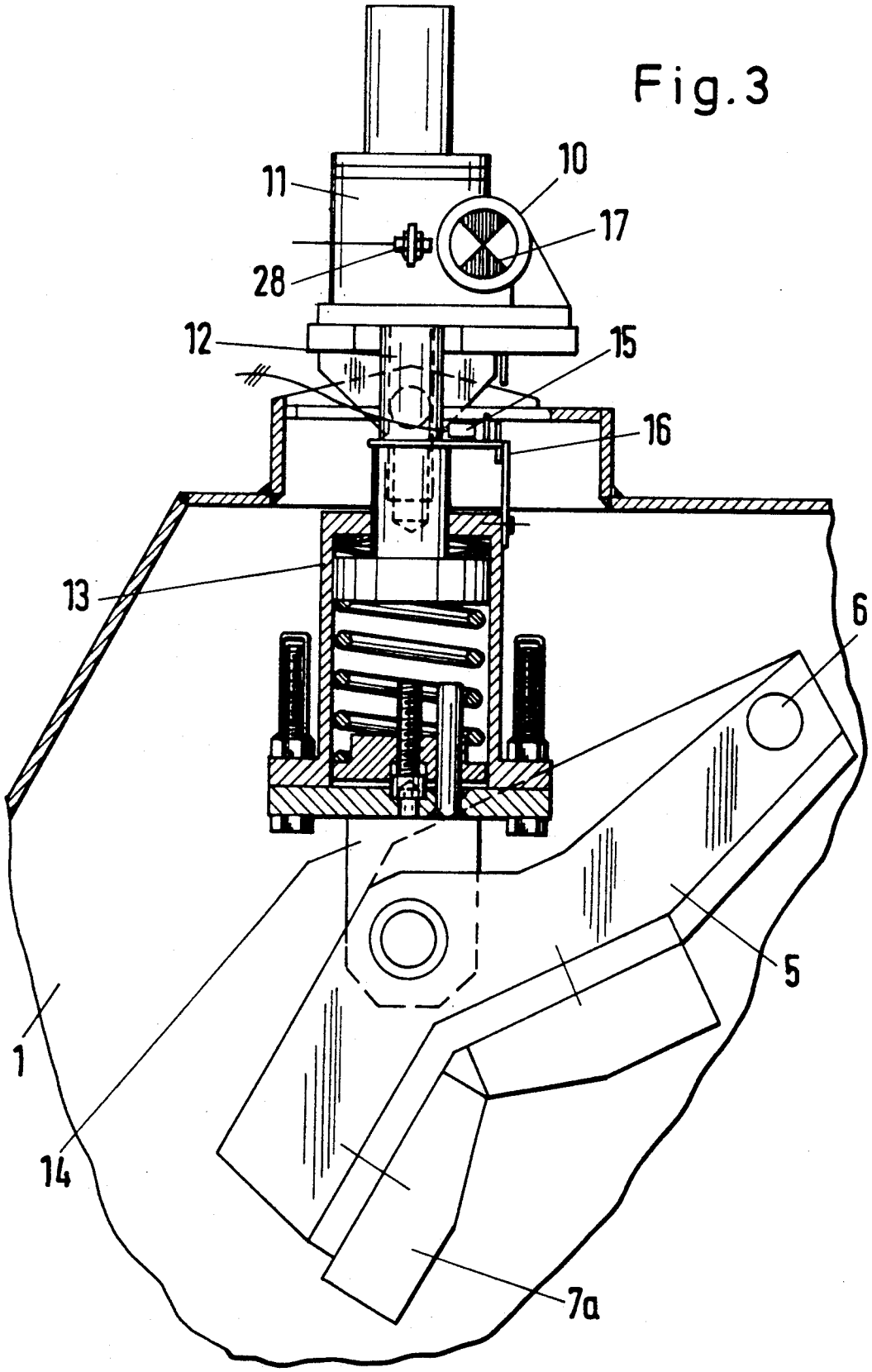
FIG. 3 is an enlarged sectional view of a detail of the comminuting machine of FIG. 1.

The output element of the motor 10 drives a toothed disc or gear 17 (FIG. 1, FIG. 3). The toothed disk or gear 17 cooperates with a proximity detector switch 28 to measure the distance which the tool 5, and more particularly the lower end portion *7a* of its plate 7, covers on its way toward or away from the path 8 for the beaters 4 of the first tool 2. The proximity detector 28 transmits appropriate signals to the corresponding input of the computer 27 so that the latter can calculate the extent of movement of the plate 7 relative to the path 8 in a direction toward or away from the first tool 2.

The housing 1 of the comminuting machine carries a microphone 18 which serves to generate electric signals proportional to the intensity of sounds generated by the first tool 2 and the drive, including the shaft 3, for the rotor of the tool 2 for the following two cases, first, when the clearance 9 is empty, i.e., when the admission of material to be comminuted is interrupted and, second, to the intensity of sounds which are generated by the tools 2 and 5 when the lower end portion *7a* of the impact plate 7 is moved so close to the shaft 3 that the width of the clearance 9 is reduced to zero and successive beaters 4 strike upon the plate 7 at a frequency which is a function of rotational speed of the shaft 3.

FIG. 2 shows that the output of the microphone 18 transmits electric signals to a preamplifier 19 which, in turn, transmits amplified signals to a second amplifier 20. The output of the second amplifier 20 is connected to the input of a first threshold circuit 23 via conductor 21 and to the input of a second threshold circuit 24 via conductor 22. The circuit 23 transmits only those electric signals which denote sounds of a first intensity such as develop when the clearance 9 is empty and the noise which is generated by the comminuting machine is attributable primarily or exclusively to rotation of the rotor and beaters 4 of the first tool 2 and the drive including the shaft 3, i.e., when the inlet *1a* of the housing 1 does not receive fresh material to be comminuted and the material which was previously admitted into the housing 1 has already advanced through and beyond the clearance 9. The output of the threshold circuit 23 is connected with the corresponding input of the computer 27, i.e., with the means for operating the motor 10 of the means for moving the second tool 5 relative to the first tool 2 in the housing 1, by way of a time delay circuit 25. The time delay circuit 25 is a retriggerable circuit which serves to generate a continuous high signal for an extended interval of time, i.e., while the comminuting machine is idling in that the shaft 3 rotates the first tool 2 but the inlet *1a* of the housing 1 does not receive material and the material which was previously admitted into the housing has already advanced through and beyond the clearance 9 so that it does not contribute to the sound and/or noise generating action of the tools.

The threshold circuit 24 is analogous to the threshold circuit 23 except that it is adjusted to generate hard signals denoting the more pronounced intensity of those sounds which are detected by the microphone 18 when the width of the clearance 9 is reduced to zero so that successive beaters 4 strike to lower end portion *7a* of the impact plate 7. The output of the threshold circuit 24 transmits high signals to the corresponding input of the computer 27 by way of a second time delay circuit 26 which is or can be analogous to the time delay circuit 25. The time delay circuit 26 can be set up in such a way that it transmits to the computer 27 a continuous high signal when its input receives signals from the threshold circuit 24 at a predetermined frequency of not less than, for example, seven signals per second. This is supposed to indicate that signals which are transmitted by the output of the threshold circuit 24 definitely denote the fact that the beaters 4 of the first tool 2 strike upon the plate 7 of the second tool 5.

FIG. 2 further shows an AC-DC converter circuit 30 which connects the amplifiers 19, 20 and the parts 15, 23–26, 28 with a source of electrical energy.

The computer 27 receives signals from the time delay circuits 25, 26, from the proximity detector switch 28 and from the switch 15. The reference character 29 denotes a switch box which connects the computer 27 with the motor 10 of the means for moving the second tool 5 about the axis of the pivot member 6. As mentioned above, the motor 10 drives the toothed disc or gear 17 which cooperates with the proximity detector switch 28 so that the latter can generate signals denoting the extent of movement of the plate 7 toward or away from the path 8 of orbital movement of the beaters 4. The computer 27 can operate the motor 10 in accordance with a preselected program to an extent which is necessary to establish a clearance 9 having a predetermined width, and such operation can take place whenever the admission of material into the inlet 1*a* is interrupted. This is to compensate for wear upon the plate 7 and/or upon the beaters 4 and, if necessary, upon the pivotal connection between the tool 5 and the housing 1 and/or the drive for the first tool 2.

The motor 10 can constitute a reversible gear motor. An output 31 of the computer 27 can transmit signals (via switch box 29) to a conveyor 32 which serves to admit material to be comminuted into the inlet 1*a* of the housing 1, i.e., the computer 27 can start or arrest the conveyor 32. The conveyor 32 is arrested preparatory to movement of the plate 7 toward and into the path of movement of the beaters 4, and the computer 27 restarts the conveyor 32 when the adjustment of the clearance 9 is completed, i.e., when the width of the clearance 9 is reduced in order to compensate for wear upon the tools or is increased if the machine is to comminute a material in such a way that relatively large particles or fragments of admitted material can pass through the clearance 9 on their way into and through the outlet of the housing 1.

The switch box 29 can contain relays and/or other electrical and/or electronic components which are used to transmit signals between the computer 27 and the motor 10 and preferably also between the computer and the conveyor 32. This switch box can further comprise manually operable switches which can be manipulated by hand and/or by keys to start or arrest the conveyor 32 and/or to start or arrest the gear motor 10 of the means for moving the second tool 5 relative to the rotor of the first tool 2. Moreover, the switch box 29 can contain or can be connected with a keyboard or other means for programming the computer 27.

The mode of operation of the comminuting machine of FIGS. 1 to 3 is as follows:

If the width of the clearance 9 is to be reduced in order to compensate for wear upon the plate 7 and/or the beaters 4, the drive including the shaft 3 continues to orbit the beaters 4 along the endless path 8, and the computer 27 or a person in charge arrests the conveyor 32 via output 31 so that the admission of material into the inlet 1*a* is interrupted and the housing 1 becomes empty after a relatively short period of time. The microphone 18 monitors the sounds which are generated by the tools in the housing 1 and by the drive for the first tool 2, and the output of the threshold circuit 23 transmits a signal to the time delay circuit 25 as soon as the intensity of sound, which is detected by the microphone 18, corresponds to that intensity of sound which develops, when the clearance 9 does not contain any comminuted or yet to be comminuted material. The time delay circuit 25 transmits a high signal to the computer 27 which already stores a signal denoting that the conveyor 32 is idle, i.e., that the admission of material to the inlet 1*a* of the housing 1 has been interrupted. The computer 27 evaluates such signals and transmits a signal to the motor 10 via switch box 29 in a sense to pivot the plate 7 in a counterclockwise direction (FIGS. 1 and 3) in order to reduce the width of the clearance 9 to zero. The switch box 29 transmits a delayed signal to the computer 27 denoting that the operation of the conveyor 32 has been interrupted. The transmission of the delayed signal is desirable and advantageous in order to ensure that the motor 10 is not started in response to a short-lasting interruption of admission of material into the inlet 1*a* of the housing 1 while the conveyor 32 is driven. Such a precautionary measure ensures that an adjustment in the width of the clearance 9 invariably takes place only and alone when the admission of material into the inlet 1*a* of the housing 1 is interrupted on the ground that the conveyor 32 is actually idle, i.e., particles of material cannot interfere with accuracy of adjustment of the distance of the plate 7 from the axis of the rotor 2.

Signals which appear at the output of the second amplifier 20 are transmitted to the threshold circuit 23, via conductor means 21, as well as to the threshold circuit 4, via conductor means 22. However, the output of the threshold circuit 24 does not transmit any operational signals until and unless the width of the clearance 9 is reduced to substantially zero, i.e., the output of the threshold circuit 24 transmits signals only when such signals denote sounds or noise having an intensity which develops when the orbiting beaters 4 actually strike the lower end portion 7*a* of the impact plate 7. However, it is possible that the output of the threshold circuit 24 transmits a signal, or even two or more signals, for reasons other than the generation of sounds as a result of impact of beaters 4 upon the plate 7. For example, random admission of individual particles of a material, such as of the material to be comminuted, into the inlet 1*a* and thence into the clearance 9 can result in the generation of one or more sounds having an intensity which suffices to entail the transmission of a signal from the output of the threshold circuit 24 to the input of the time delay circuit 26. Therefore, the time delay circuit 26 is preferably designed to transmit a high signal only then to the computer 27 when the time delay circuit 26 receives a series of successive signals at a predetermined frequency, preferably at a frequency corresponding to that at which successive beaters 4 strike the plate 7 when the width of the clearance 9 is reduced to zero. This prevents untimely stoppage of the motor 10 and premature reversal of the direction of movement of the plate 7 relative to the first tool 2.

The arrangement is preferably such that the motor 10 moves the plate 7 toward the path 8 at a relatively low speed so as to prevent an abrupt and very pronounced impingement of beaters 4 upon the plate 7 and to ensure that such movement of the plate 7 toward the shaft 3 can be terminated as soon as and immediately when the microphone 18 has detected and signalled the generation of a preselected number of successive sounds where the intensity of the sounds is indicative of actual impingement of the beaters 4 upon the plate 7 and wherein the sounds are generated at a frequency corresponding to that at which successive beaters 4 advance past the lower end portion 7*a* of the plate 7 based on the rotation speed of the rotor or the first tool 2. As mentioned above, the time delay circuit 26 can be designed to transmit a continuous high signal only when the output of the threshold circuit 24 transmits a predetermined number of successive high signals at a predetermined frequency. Such a high signal causes the computer 27 to arrest the motor 10 and thereupon to start the motor 10 in reverse in order to initiate a movement of the plate 7 away from the path 8. This invariably indicates that the just discussed signals were generated by the microphone 18 as a result of the generation of sounds developing while the beaters 4 strike the plate 7.

The computer 27 continuously receives signals denoting the distance of the plate 7 from the path 8 and/or from the axis of the shaft 3. This is due to the provision of the toothed disc or gear 17 and the proximity detector switch 28. The latter proximity detector switch 28 is connected to a corresponding input of the computer 27. Such signals enable the computer to arrest the motor 10 at the exact instant when the width of the clearance 9 reaches a preselected value. Arresting the motor is associated with terminating the movement of the plate 7 away from the shaft 3. This width of the clearance 9 can be somewhat less than the width present prior to a starting of the adjustment if the computer 27 is to compensate only and alone for wear upon the parts of the comminuting machine. However, the newly selected width can exceed the previous width if the computer 27 is to compensate for eventual wear upon the parts of the machine and/or to select a greater width for proper comminution of the same material or of a different material which is intended to have a different, and for example larger, ultimate particle size.

The arrangement may be such that a counter 129 of the computer 27 is reset to zero whenever the movement of the plate 7 toward the shaft 3 is terminated and whenever the movement of the plate 7 away from the shaft 3 is completed. The counter 129 is then capable of ascertaining the initial width of the clearance 9 as well as of continuously indicating the increasing width of the clearance while the motor 10 is operated in a sense to pivot the plate 7 of the second tool 5 in a clockwise direction, as seen in FIGS. 1 and 3. The counter can count the number of revolutions or portions of revolutions of the output shaft of the motor 10.

The new distance of the plate 7 from the shaft 3 can be selected on the basis of information which is stored in the computer 27 and is gathered on the basis of experiments. All operations are or can be automated even though the parts in the switch box 29 enable an operator to override the computer 27 and to manually control the movements of the plate 7 toward and/or away from the shaft 3. The computer 27 can further store information which enables it to automatically arrest the conveyor 32 at predetermined intervals of time in order to initiate an adjustment of the width of the clearance 9 for the purpose of ensuring that the maximum size of particles issuing from the housing 1 will not exceed a preselected value.

An advantage of the signal which is transmitted by or to the computer 27 and denotes that the conveyor 32 is arrested is that the movement of the motor 10 in a direction to reduce the width of the clearance 9 to zero is started only when the housing 1 does not contain any comminuted or yet to be comminuted material. All that is necessary is to delay operation of the motor 10 for an interval of time which normally or invariably suffices to ensure that all particles which have entered or were already received in the housing 1 at the time of stoppage of the conveyor 32 are evacuated or have been advanced beyond the clearance 9 so that they do not appreciably contribute to the generation of sound which is monitored by the microphone 19.

An advantage of the signals which are transmitted by the threshold circuit 23 and time delay circuit 25 is that the computer 27 starts the motor 10 in a sense to reduce the width of the clearance 9 only while the rotor of the first tool 2 is driven by the shaft 3. This is desirable and advantageous because orbiting of the beaters 4 is a prerequisite for the generation of sounds having an intensity which denotes that they are generated as a result of impingement of successive beaters 4 against the lower end portion 7*a* of the impact plate 7.

An advantage of the signal or signals which are transmitted by the time delay circuit 26 is that the computer 27 terminates the movement of the plate 7 toward the path 8 of the beaters 4 and reverses the direction of pivotal movement of the plate 7 only when the width of the clearance 9 has been reduced to zero. This enables the computer to terminate the movement of the plate 7 away from the path 8 at the exact instant when the width of the growing clearance 9 reaches the preselected value.

The invention can be embodied with equal or similar advantage in so-called roll crushers or roll mills wherein a first drum-shaped or similar tool is rotatable about a fixed first axis and a second drum-shaped or similar tool is rotatable about a second axis and the second axis is movable toward and away from the first axis. The clearance which is defined in such roll crusher or roll mill is the nip of the two rotary drum-shaped or similar tools. The noise which is generated when the second tool is caused to actually engage the first tool is sufficiently pronounced to enable the microphone to discriminate between such noise and the noise which is generated by the roll crusher when its housing does not contain any comminuted or yet to be comminuted material. The beaters of the first tool in a roll crusher or roll mill are the unevennesses of the drum and/or ribs or otherwise configurated comminuting or crushing protuberances at the periphery of the first tool.

If the time delay circuit 26 of FIG. 2 is designed to transmit to the computer 27 individual signals which develop whenever the microphone 18 registers a sound or noise having an intensity matching or approximating the sounds which are generated while the beaters 4 strike the impact plate 7, then a premature movement of the plate 7 away from the path 8 of orbital movement of the beaters 4 can be prevented in the following way: The computer 27 causes the motor 10 to interrupt the movement of the plate 7 toward the path 8 in response to a first signal from the time delay circuit 26. Such a preselected interval of time can be represented by an interval denoting that signals at the output of the time delay circuit 26 are attributable to noise which is generated by the beaters 4 striking the plate 7. The computer 27 restarts the motor 10 in a direction to move the plate 7 toward the shaft 3 if such signal is not followed by a second signal within a preselected interval of time. The movement of the plate 7 toward the shaft 3 is interrupted again when the computer 27 thereupon receives a predetermined number of discrete signals at a predetermined frequency or a single signal which is generated only when the threshold circuit 24 transmits n successive signals at a predetermined frequency. This indicates that the beaters 4 actually strike the plate 7, i.e., that the width of the clearance 9 has been reduced to zero and the direction of rotation of the motor 10 can be reversed in order to proceed with the step of widening the clearance to the preselected value.

A stoppage of the machine can be based on an interruption of admission of material into the inlet 1*a* of the housing 1. The computer 27 is or can be programmed in such a way that it automatically initiates a stoppage of the conveyor 32 at preselected intervals and that the narrowing and subsequent widening of the clearance 9 is carried out in the aforedescribed sequence and in response to aforediscussed signals denoting: a stoppage of the conveyor 32, an evacuation of material from the housing 1 and generation of sounds denoting that the housing is empty, and impingement of beaters 4 against the impact plate 7. The computer 27 preferably restarts the conveyor 32 to resume the admission of material into the inlet 1*a* of the housing 1 as soon as the adjustment of width of the clearance 9 is completed.

If the material to be comminuted is relatively soft, the computer 27 can be programmed in such a way that it adjusts the width of the clearance 9 prior to start of a shift and thereupon remains inactive for the duration of the shift. Such single adjustment per day or per shift normally suffices if the wear upon the beaters 4 and upon the plate 7 is not very pronounced. Of course, the switch box 29 enables an attendant to change the width of the clearance 9 when necessary irrespective of programming of the computer 27.

Programming of the computer 27 can be carried out in such a way that the width of the clearance 9 is selected in dependency upon the desired maximum size of comminuted material and that such width is thereupon maintained by more or less frequent stoppage of the conveyor 32 or another material admitting device or feeding device, where the stoppage is followed by a reduction of the width of the clearance 9 to zero and a subsequent widening of the clearance to a value which is necessary to achieve the desired comminution of rock, coal or other material. The programming of the computer 27 can be altered while the comminuting machine is in actual use. A freshly programmed computer then arrests the conveyor 32 to thereupon reduce and subsequently increase the width of the clearance 9 to the desired value.

It is equally within the purview of the invention to employ the illustrated microphone 18 for the generation of electric signals which are transmitted to the threshold circuit 23, and to employ a discrete second microphone to monitor sounds which are generated by the beaters 4 when striking the plate 7 and to transmit signals to the threshold circuit 24. The illustrated arrangement is preferred at this time because it contributes to simplicity and lower cost of the comminuting machine.

The proximity detector switch 28 constitutes a desirable but optional feature of the improved comminuting machine. Thus, the computer 27 could be programmed to control the operation of the motor 10 in a direction to move the plate 7 away from the beaters 4 by ensuring that the motor 10 is driven for a given interval of time which is necessary to increase the width of the clearance 9 from zero to a preselected value. The proximity detector switch 28 is preferred at this time because it enables the computer 27 to continuously compare the actual distance of the plate 7 from the path 8 with a preselected distance and to arrest the motor 10 at the exact instant when the width of the clearance 9 reaches the preselected value.

The computer 27 can be connected with a further subsidiary microprocessor or computer 33 which is to receive information for calculation of the total output of the comminuting machine per shift or per another unit of time. The acticipated useful life of the tools and the periods of use of the tools and/or other data are calculated by the computer 27. This will allow to ensure a timely replacement of spent tools. Moreover, the computer 27 and/or the computer 33 can be provided with one or more display units 133 which display certain information such as the output per unit of time, the total output over a longer period of time, the monitored wear upon the tools and/or other information. Such total automation of operation of the comminuting machine contributes to a further increase and enhanced quality of output and ensures that an interruption of operation, save for those interruptions which are to be induced by the computer 27 for the purpose of first reducing and thereupon increasing the width of the clearance 9 at preselected intervals, is necessary only when the one and/or the other tool must be replaced as a result of extensive wear or for any other reason.

The computer 27 can be programmed to automatically arrest the conveyor 32 and to thereupon initiate a reduction and subsequent increase of width of the clearance 9 in response to monitoring of the maximum size of particles which issue from the housing 1. If the maximum size is excessive, the computer 27 initiates a reduction of the width of the clearance 9 to a value which is necessary to reduce the size of comminuted material to the desired maximum permissible value.

The resilient insert or cushion 13 can be of the type disclosed in published German Patent Application No. 3,525,101 or in European Patent No. 0,019,541. As mentioned, above, this cushion enables the impact plate 7 to yield when the clearance 9 receives one or more extremely hard particles which are likely to damage the first and/or the second tool. Thus, the plate 7 can assume the aforediscussed "inoperative" or retracted position in which the width of the clearance 9 is excessive during the time interval which elapses for advancement of one or more extremely hard particles through and beyond the clearance.

The provision of the cushion 13 is desirable and necessary even though it enables the plate 7 to temporarily assume a position at an excessive distance from the axis of the shaft 3. Moreover, it can happen that particles of material, admitted via inlet 1*a*, become wedged between the parts of the cushion 13 and/or between the plate 7, while in the inoperative position of such plate, and the housing 1 to prevent an immediate return movement of the plate 7 to the prescribed position as soon as the extremely hard particle or particles have advanced beyond the clearance 9. This can also result in damage to the motor 10 and/or to other parts of the means for moving the plate 7 toward or away from the tool 2 and its beaters 4. Therefore, the comminuting machine preferably comprises the aforementioned switch 15 which signals to the computer 27 that the plate 7 is held in the inoperative position and thus ensures that the computer does not start the motor 10 as long as the signal from the switch 15 indicates that the plate 7 is maintained in the inoperative position.

The illustrated cushion 13 comprises one or more dished springs and/or one or more coil springs and/or other yieldable mechanical biasing means. Such cushion is compressed and stores energy when the plate 7 is caused to assume its inoperative position. If the motor 10 were permitted to drive its output element in a direction to move the plate 7 from inoperative position toward the path 8 of orbital movement of the beaters 4, the spindle 12 would cause the already stressed cushion 13 to store additional energy. This could cause the cushion 13 to abruptly propel the plate 7 toward and into the path 8 with attendant considerable damage to or total destruction of the first and/or second tool. In many instances, the temporarily compressed cushion 13 is free to expand and to return the plate 7 to its proper position relative to the beaters 4 in response to vibration which develop when the comminuting machine is in use. Thus, as a rule, the duration of dwell of the plate 7 in the inoperative position, where the cushion 13 is stressed, is relatively short so that the computer 27 can resume its normal operation as soon as the signal at the output of the switch 15 disappears.

If desired, the signal which is generated by the switch 15 to denote that the plate 7 is held in an inoperative position can be displayed in the computer 27, in the subsidiary microprocessor or computer 33, or in a separate signal displaying unit so that the attendants can ascertain and eliminate the cause of retention of plate 7 in the inoperative position if such condition is not changed automatically, e.g., in response to vibration of the housing 1 when the comminuting machine is in use. The person in charge, who has detected a signal denoting that the plate 7 is blocked in an inoperative position at an excessive distance from the path 8 of orbital movement of the beaters 4, can facilitate a return movement of the plate 7 to its prescribed position, e.g., by actuating a control element 130 in the switch box 29 for the purpose of shaking the plate 7 back and forth about the axis of the pivot member 6 in order to thus promote the dislodging of particles which have caused the plate 7 to become jammed or wedged at an excessive distance from the path 8. Alternatively, the signal at the output of the switch 15 can induce the computer 27 to initiate an oscillatory movement of the plate 7 about the axis of the pivot member 6 for the purpose of enabling the cushion 13 to repeatedly store and dissipate energy and to rapidly return the plate 7 to its intended or selected position. The computer 27 is thereupon free to arrest the conveyor 32 and to move the plate 7 first toward and thereupon away from the shaft 3. The motor 10 is or can be an electric gear or stepping motor.

The illustrated cushion 13 comprises one or more mechanical springs. However, and as described in the aforementioned published German Patent Application No. 3,525,101, it is equally possible to employ a fluid-containing or fluid-operated cushion, e.g., a pneumatic cushion. The switch 15 is then replaced with a pressure-responsive switch which generates a signal when the pressure of the supply of gaseous fluid in the pneumatic cushion reaches a preselected value which indicates that the position of the impact plate of the second tool can be classified as an inoperative position and that the computer 27 should not start the motor 10 before the second tool is free to reassume its prescribed position. The pressure monitoring device which is shown at 21 in FIG. 2 of the published German Patent Application No. 3,525,101 serves to facilitate regulation of the pressure of confined gaseous fluid so that such pressure is maintained at a substantially constant value. If such pneumatic cushion is used in the comminuting machine of the present invention, the pressure monitoring device is used to transmit signals to the computer 27 for the purpose of initiating vibration of the second tool and/or of preventing the motor 10 from moving the spindle 12 before the second tool reassumes its prescribed position.

In accordance with a presently preferred embodiment, each of the threshold circuits 23, 24 comprises a microphone preamplifier, e.g., a preliminary amplifier of the type known as B 90 (#6—172), which is distributed by Kemo, Federal Republic Germany, an LED percent modulation indicator, LED-volt- and amperemeter of the type known as B 111 (#16.172) by Kemo, wherein the light emitting diodes L2 to L11 are replaced with optocouplers ILD 74, and amplifier means of the type known as B 72 (#18—170 by Kemo).

Each of the retriggerable time delay circuits 25, 26 can constitute a commercially available component, for example, of the type described on pages 448–449 of "Halbleiter-Schaltungstechnik" by U. Thietze and Ch. Schenk (Fifth Edition).

The computer 27 can be an IBM personal computer model or a compatible model, preferably an XT design (processor 8086) or larger, which is equipped with auxiliary platens and printed circuit board for the processing of output signals and RPM values and for regulation of servomotors. The processing of output and input signals can be performed, i.e. with control interface card No. A 1220 of Analog-Digitaltechnik Schnellhammer, Federal Republic of Germany.

It will be understood that each of the elements described above, or two or more together, may also find a useful application in other types of adjustment apparatus differing from the types described above.

While the invention has been illustrated and described as embodied in the context of a method and apparatus for adjusting comminuting machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of operating a comminuting machine, wherein a driven first tool carries beaters which move along a predetermined path adjacent a mobile second tool to define a clearance with the second tool, said clearance determines the particle size of the comminuted product as a result of admission into the clearance, comprising the steps of interrupting the feeding of material into the machine; allowing the machine to be emptied of material;

generating first signals based on a first sound of the emptied machine;

electronically processing the first signals corresponding to said first sound having a first sound intensity of said machine running without feed of materials after an evacuation of comminuted material from the machine;

feeding said processed first signals to a drive connected to said second tool and initiating a drive;

moving said second tool actuated by said drive toward said path of the beaters until said beaters strike said second tool with attendant generation of a second sound having a predetermined second intensity;

electronically processing and distinguishing a second signal derived from said second sound of the second intensity from said first signal representing said first sound intensity; and retracting said second tool from said path in response to the generation of said second sound to establish a clearance having a predetermined width.

2. The method of claim 1 of operating a comminuting machine wherein said comminuting machine generates a third sound, representing loaded running and having a third intensity generally larger than said predetermined first intensity in absence of material, said moving step further comprising monitoring sounds of the machine;

generating a first signal when the intensity of monitored sounds falls below said third intensity; and utilizing said first signal to terminate associated with an emptying of the machine and to begin a moving step of said second tool toward said first tool.

3. The method of claim 2 of operating a comminuting machine which is an impact crusher and wherein said first tool has a rotor which orbits its beaters along an endless path, further comprising the step of repeating said interrupting, generating, processing, feeding, moving and retracting steps at suitable time intervals to compensate for wear upon said tools.

4. The method of claim 1 of operating a comminuting machine wherein said beaters strike said second tool at predetermined time intervals, wherein the duration of the predetermined time intervals is a function of the speed of advancement of said beaters along said path with attendant generation of a series of second sounds having said second intensity, further comprising the steps of monitoring the intensity and frequency of second sounds and generating second signals when the intensity of said second sounds corresponds to one of said second sound intensities;

interrupting said moving step in response to a first one of said second signals;

resuming the moving step when the time interval between said first one of said second signals and a next-following second signal is longer than one of said predetermined time intervals; and starting said retracting step in response to the generation of a predetermined number of second signals occurring at said predetermined time intervals.

5. The method of claim 1 of operating a comminuting machine, wherein said beaters strike said second tool at predetermined intervals, the duration of which is a function of the speed of advancement of beaters along said path with attendant generation of a series of second sounds having said predetermined second intensity, further comprising the steps of monitoring the intensity and frequency of said second sounds and generating second signals when the intensity of said second sounds corresponds to said predetermined second intensity;

interrupting the moving step in response to said second signal; and starting said retracting step in response to the generation of a predetermined number of said second signals spaced in time as corresponding to a predetermined frequency.

6. The method of claim 1, further comprising the step of repeating said interrupting, moving and retracting steps after an elapse of time intervals depending upon the nature of material to be comminuted.

7. The method of claim 1, further comprising the step of terminating said retracting step as a function of the desired size of comminuted material.

8. The method of claim 1 of operating a comminuting machine, wherein in the absence of material the machine generates the first sound representing running without load and having the first sound intensity less than said second predetermined intensity, and further comprising the steps of monitoring the sounds;

generating said first signals in response to detection of first sounds having a predetermined first intensity;

generating second signals in response to detection of sounds having said second intensity;

utilizing said second signals to interrupt said moving step; and utilizing said first signals to terminate a delay period set after said second signal is received.

9. The method of claim 1 of operating a comminuting machine, wherein the second tool assumes an inoperative position and to thus increases said clearance in response to admission of material having a predetermined hardness, further comprising the step of monitoring the position of said second tool and blocking said moving step when said second tool assumes said inoperative position.

10. A comminuting machine, particularly an impact crusher, comprising a housing having an inlet for material to be comminuted therein;

a first tool movably mounted in said housing and having a plurality of beaters;

drive means connected with said first tool to move said beaters in said housing along a predetermined path;

a second tool movably mounted in said housing adjacent said path and together with said first tool defining a clearance; moving means operable to move said second tool relative to said first tool to thus vary the width of said clearance; and control means including means for generating first signals denoting the first intensity of said first sound which is generated by the machine running in the absence of material to be crushed;

means for generating second signals denoting the second intensity of second sounds which are generated when the width of said clearance is zero so that said beaters strike said second tool;

electronic means for separating one of said first signals from one of said second signals; and means for operating said moving means in response a first signal to reduce the width of said clearance and thereupon in response to a second signal to increase the width of said clearance to a predetermined value.

11. The machine of claim 10, wherein said means for generating said first and second signals comprises a microphone having an output for electric signals dependent on a monitored intensity of said first and second sounds;

means for amplifying said electric signals;

a first threshold circuit connected with said amplifying means and having an output for said first signals connected with said operating means; and a second threshold circuit connected with said amplifying means and having an output for said second signals connected with said operating means.

12. The machine of claim 11, wherein said operating means includes a computer and a time discriminator for said first and second signals.

13. The machine of claim 11, further comprising a time delay circuit means connected between the output of at least one of said threshold circuits and said operating means.

14. The machine of claim 10, wherein said operating means comprises means for effecting a movement of the second tool away from said first tool in response to reception of a predetermined number of second signals.

15. The machine of claim 10, wherein said operating means includes means for initiating resumption of admission of material into said inlet in response to widen said clearance to said predetermined value.

16. The machine of claim 10, wherein said second tool includes an impact member and a cushion which yields to permit a movement said member to an inoperative position in response to penetration into said clearance of a material having a predetermined hardness, said control means further comprising means for monitoring the position of said member and for preventing operation of said moving means in a direction to reduce the width of said clearance in said inoperative position of said member.

17. Method for the operation of a comminuting machine, which comprises associating a first rotating comminution tool with at least a second comminution tool, adjusting the second comminution tool in its position relative to the first rotating comminution tool, forming an adjustable grinding gap between the first rotating comminution tool and the second comminution tool, performing a forward motion at certain time intervals with the second comminution tool for avoiding substantial changes of the grain size of the comminuted material by a drive in an empty-running comminution machine toward said first rotating comminution tool up to a first contact with said first rotating comminution tool, performing a reversal motion with said second comminution tool to result in a desired distance from said first rotating comminution tool after observation of a noise caused by the first contact between said first rotating comminution tool and said second comminution tool which is made perceptible by a microphone, automatically determining the motion of the second comminution tool with a computer for a start of the forward motion, for a starting point in time of a reversal motion, and at an end of the reversal motion, switching on the drive of the second comminution tool to therefore initiate the motion of the second comminution tool toward the first rotating comminution tool if (a) a first signal reaches the microprocessor, said signal is generated after a switching off of a feeding of material and said signal is fed with a delay to the computer that upon reaching the computer, the comminution machine has been emptied of material to be processed, and (b) a second signal reaches the microprocessor, said second signal originates from a microphone furnished at a casing of the comminution machine and said second signal, upon filtering a third signal generated by the general running noises, results in a second filtered signal essentially generated only by hard noises which result from the contacting of said second comminution tool with said first rotating comminution tool, (c) the third signal reaches the microprocessor, said third signal originates from a microphone disposed at the casing of the comminution machine and said third signal is generated by the general noises of the running of the comminution machine under a load, wherein the microprocessor reverses the motion of said second comminution tool and stops the motion of the second comminution tool after a certain distance which is calculated from the reversal position.

18. Method according to claim 17, further comprising immediately stopping the motion of the second comminution tool toward the first comminution tool upon occurrence of said filtered second signal, generated by said hard noises, and wherein the motion is picked up again if no further said filtered second signals follow, and wherein the motion is reversed, if a certain strength and length or a certain minimum number of said filtered second signals are received within a certain time unit which indicates to the microprocessor the mutual contacting of the comminution tools.

19. Method according to claim 17, further comprising deriving said second signal and said third signal from one and the same microphone by distribution each of said second signal and said third signal from the microphone after amplification to two separate channels.

20. The method according to claim 17, further comprising employing an impact mill as a comminution machine, wherein the impact mill includes a rotor equipped with impact bars and at least an impact plate coordinated to the rotor, whereby the impact plate is adjustable relative to the rotor and forms a grinding gap with the rotor, wherein moving the impact plate toward the rotor at certain time intervals by way of a drive up to the first contact with the impact bars of the rotor in an empty-running impact mill, in order to avoid substantial changes of the granulometry of the comminuted material by reversing the motion, of the impact plate is brought to the desired distance for operating relative to the rotor, based on said noise resulting from the contact made recognizable by a microphone, wherein a control of the motions of the impact plate, includes the start of the forward motion, the point in time of the reversal motion, and the end of the reversal motion, are automatically performed by a microprocessor, wherein the microprocessor switches on the drive of the impact plate and thereby initiates the motion of the impact plate toward the rotor, if (a) a switching signal is obtained by the microprocessor, said switching signal is generated by the switching off of the material feed and is delivered with a delay to the microprocessor that the impact mill has been emptied when said switching signal reaches the microprocessor, and (b) said third signal is obtained by the computer, said third signal originates from a microphone furnished at the casing of the impact mill and said third signal is generated by the general running noises of the impact mill, and wherein the microprocessor reverses the motion of the impact plate and stops the motion of the impact plate after a certain distance, calculated from the reversal position if (c) said second signal is obtained by the microprocessor, said second signal originates from the microphone which is furnished at the casing of the impact mill and said second signal by filtering said third signal which is generated by the general running noises, is generated from the hard noises as a result of the contact between impact plate and the impact bars.

21. Method according to claim 20, further comprising immediately stopping the motion of said second comminution tool, which operates as an impact plate toward said first comminution tool upon occurrence of said filtered second signal, generated by said hard noises, and wherein the motion is picked up again if no further said filtered second signals follow, and wherein the motion is reversed, if a certain strength and length in a certain time unit indicates to the microprocessor the mutual contacting of said comminution tools.

22. Method according to claim 20, further comprising determining time intervals with said microprocessor by an exchangeable program furnished for a specific material to be comminuted and coordinated to said microprocessor, during said time intervals a readjustment of the impact plate occurs where said microprocessor initiates the material feed is stopped before the material feed is restarted, respectively.

23. Method according to claim 20, wherein the microprocessor determines the distance of the impact plate to the rotor depending on a desired grain structure by an influenceable program coordinated to said microprocessor, and said microprocessor performs automatically a setting of the impact plate and thus of said grinding gap.

24. Method according to claim 20, further comprising deriving said first signal and said second signal from one and the same microphone by distributing each of said first signal and said second signal from said microphone after amplification to two separate channels.

25. Method according to claim 20 for impact mills, further comprising operating the drive of the impact plate with an elastic intermediate member, said elastic intermediate member allows an escaping of the impact plate at any time when non- comminutable parts have passed into said impact mill, and wherein the drive is stopped during the forward motion, if said elastic intermediate member is pressed together from a drive side because of a jamming of a rebound works.

26. An apparatus for automatically adjusting a grinding gap of a comminuting machine for determining the grain size, comprising a first rotating comminution tool and at least a second comminution tool furnished with drive aggregates for positional adjustment, wherein said second comminution tool can be adjusted by said drive aggregates relative to said first rotating comminution tool, and a microphone disposed in a casing of the comminution machine;

a microphone amplifier (19) connected to said microphone (18);

a channel transmitting an amplified signal which comes from the microphone (18) and is subdivided into two channels (21,22), wherein a first channel is led via a first signal decoupler (23) with a low trigger threshold, and wherein a second channel is led via a second signal decoupler (24) with a high trigger threshold to a microprocessor (27), wherein said microprocessor (27) is programmed to switch on the drive aggregates to sense the approaching of said second comminution tool to said first rotating comminution tool and upon receiving a time-delay signal derived from the switching off of the material feed, wherein said microprocessor reverses this motion as soon as a second signal reaches said microprocessor which surpasses said high trigger threshold in a certain strength and said second signal is of a longer time duration, wherein said microprocessor stops the reverse motion based on a program entered into said microprocessor, and said microprocessor reinitiates the feeding of material into said comminuting machine.

27. Apparatus according to claim 26, wherein time switches (25, 26) are connected to said signal decouplers (23, 24), and wherein said time switches (25, 26) can be triggered at a later point in time.

28. An apparatus for automatically adjusting an impact plate of an impact mill comprising an impact plate;

a casing of the impact mill;

a drive aggregate for said impact plate, said drive aggregate impact plate can be adjusted relative to a rotor impact circle;

a microphone disposed in said casing of said impact mill;

amplifiers (19, 20) connected to said microphone (18);

a channel transmitting an amplified signal comes from said microphone (18) and is subdivided into two channels (21, 22), of which said two channels (21, 22) includes a first channel that leads to a first signal decoupler (23) with a low trigger threshold, and a second channel that leads to a second signal decoupler (24) with a high trigger threshold to a microprocessor (27) wherein said microprocessor (27) is programmed to receive a time-delay signal derived from the switching off of the material feed, said microprocessor switches on said drive aggregate (10, 11) when said impact plate (5, 7) approaches said rotor impact circle (8), wherein said microprocessor reverses this motion as soon as a second signal reaches said microprocessor in a repeated successive sequence, and said second signal surpasses said high trigger threshold, wherein said microprocessor stops the reverse motion based on a program entered into the microprocessor, and wherein said microprocessor reinitiates the feeding in of material into the impact mill.

29. Apparatus according to claim 28, wherein time switches (25, 26) are connected to said signal decouplers (23, 24), and wherein said time switches (25, 26) can be triggered at a later point in time.

30. Apparatus according to claim 28, wherein switching elements (15, 16) are furnished as part of the elastic intermediate member (13) and are movable with respect to each other, wherein upon compression at said intermediate member (13), said switching elements (15, 16) change their switching state from a drive side to generate said second signal, said second signal stops the drive motion of said impact plate (5, 7) via said microprocessor (27), and modifies the drive motion of said impact plate (5, 7), respectively into a repeated short backward and forward motion until said switching state of said switching elements (15, 16) no longer exist.

31. A method for operating a comminuting machine comprising moving a second comminuting tool in a forward direction by a drive toward a first rotating comminution tool up to a first contact with said first rotating comminution tool in an empty-running comminution machine for avoiding substantial changes of the grain structure of the comminuted material, wherein said second comminution tool is coordinated to said first rotating comminution tool, wherein said second comminution tool adjustably disposed in its position relative to a position of said first rotating comminution tool, wherein a motion of said second comminution tool is automatically controlled with a microprocessor, wherein said first rotating comminution tool and said second comminution tool form an adjustable grinding gap;

receiving a switching signal in the microprocessor, said switching signal is generated by a switching off of a feeding of material and said switching signal is fed with a delay to said microprocessor that reaches the microprocessor and the comminution machine has been emptied of material to be processed;

receiving a first signal in said microprocessor, wherein said first signal originates from a microphone disposed in the casing of said comminution machine and said first signal is generated by the general noises of the running of the comminution machine;

switching on a drive of said second comminution tool via the microprocessor to initiate a forward motion of said second comminution tool toward said first rotating comminution tool to define a starting time of said forward motion;

generating a second signal with the microphone member in the casing of the comminution machine and feeding said second signal to said microprocessor, wherein said second signal is filtered and separated from said first signal generated by the general running noises, wherein said second signal is essentially generated only by said hard noises, which result upon the contacting of the second comminution tool contacts the first rotating comminution tool;

initiating a reverse motion of said second comminution tool via said microprocessor to obtain a desired distance of said second comminution tool from the first rotating comminution tool after observing said noise caused by the contact of said first comminution tool with said second comminution tool which is made perceptible by said microphone;

calculating a stop position based on the reversal position with said microprocessor;

stopping the reverse motion of said second comminution tool after a certain distance has been covered with said microprocessor.

32. The method according to claim 31 further comprising operating said second comminution tool as an impact plate toward said first comminution tool;

stopping the motion of said second comminution tool immediately upon occurrence of a filtered second signal, generated by the hard noises; and picking up the motion again if no further filtered signals follow said filtered second signal; and reversing the direction if the features of said filtered second signal in a certain time unit indicate to said microprocessor a mutual contacting of said comminution tools.

33. The method according to claim 31 further comprising deriving said first signal and said second signal from said microphone serving simultaneously as a microphone member;

amplifying said first signal and the second signal delivered by said microphone;

distributing each of said first signal and said second signal delivered by said microphone after amplification into two separate channels.

34. The method according to claim 31 further comprising adjusting an impact plate means relative to a rotor which is part of said first comminution tool in a comminution machine furnished as an impact mill for providing a desired grinding gap, wherein said impact mill includes said first comminution tool equipped with impact bars and said impact plate means furnishes said second comminution tool and is coordinated to said rotor;

moving said impact plate means toward said rotor at certain time intervals by said drive up to said first contact of said impact bars of the rotor in an empty-running impact mill in order to avoid substantial changes of the granulometry of the comminuted material;

bringing said impact plate means to a desired distance relative to the rotor for reversing the direction of the motion based on said noise resulting from the contact between said impact plate means and said impact bars which is made recognizable by said microphone member;

automatically controlling any motion of said impact plate means with a microprocessor which includes a start of a forward motion, a point in time of a reversal motion, and an end of the reversal motion;

feeding said switching signal to said microprocessor, wherein said switching signal is generated by the switching off of the material feed and wherein the switching signal is delivered with a delay to said microprocessor so that said impact mill has been emptied when the switching signal reaches said microprocessor;

feeding said first signal to said microprocessor, wherein said first signal originates from said microphone furnished in said casing of said impact mill and said first signal is generated by the general running noises of the impact mill;

switching said drive of said impact plate means on with said microprocessor to initiate said motion of said impact plate means toward said rotor;

feeding said second signal to said microprocessor, wherein said second signal originates from said microphone furnished in said casing of said impact mill and said second signal, which is filtered and separating from said first signal that is generated by the general running noises, is generated from said hard noises which is the result of the contacting between said impact plate means and said impact bars;

reversing the motion of said impact plate means with said microprocessor;

calculating a stop position of said impact plate means based on the reversal position of the impact plate means with the microprocessor;

stopping the motion of said impact plate means after a certain distance corresponding to said calculated stop position.

35. The method according to claim 34 further comprising immediately stopping the motion of the second comminution tool toward the first comminution tool when said filtered second signal that is generated by a hard noise occurs;

resuming the motion of said second comminution tool toward said first comminution tool again if no further filtered second signals are following;

reversing the motion of said second comminution tool toward said first comminution tool if certain features of said filtered second signal within a certain time unit indicate to said microprocessor an occurrence of a mutual contacting of said comminution tools.

36. The method according to claim 34 further comprising feeding microprocessor instructions which forms a program to said microprocessor for determining time intervals to be furnished for performing a readjustment of said impact plate means for a specific exchangeable material to be comminuted and coordinated to said program, and wherein said microprocessor initiates the stopping of the material feed before performing said readjustment and then the material feed is restarted respectively, after performing said readjustment.

37. The method according to claim 34 further comprising determining the distance of said impact plate means to said rotor with said microprocessor depending on a desired grain structure with a program entered into said microprocessor;

setting a position of said impact plate means to set the grinding gap automatically by using an output of said microprocessor.

38. The method according to claim 34 further comprising deriving said first signal and said second signal from said microphone;

amplifying said first signal and said second signal delivered by the microphone;

distributing said first signal and said second signal delivered to said microphone after amplification into two separate channels.

39. The method according to claim 34 further comprising driving said impact plate means of the impact mill with an elastic intermediate member;

allowing resilient retraction of said impact plate means when non-comminutable parts have passed into said impact mill based on the elastic properties of said elastic intermediate member;

stopping said drive during the forward motion, if said elastic intermediate member is pressed together from the drive side because of a jamming of a rebound works.

40. Automatically adjusting a grinding pag of a comminution machine by determining the grain size of the output of the comminution machine comprising a casing of the comminution machine;

a first rotating comminution tool;

a second comminution tool;

a drive aggregate for a positional adjustment of said second comminution tool, wherein the position of said second comminution tool can be adjusted by said the drive aggregates relative to the position of siad first rotating comminution tool;

a microphone disposed in the casing of said comminution machine;

a microphone amplifier having an output and connected to an output port of said microphone;

a first signal decoupler with a low trigger threshold having an output and having an input connected to said output of the amplifier and forming a first signal channel;

a second signal decoupler with a high trigger threshold having an output and having an input connected to said output of said amplifier and forming a second signal channel, thus subdividing an amplified signal coming from said microphone into two separate channels;

a feed means for the material to be processed in said comminution machine;

a switch connected to said feed means for turning said feed means on or off and said switch having an input;

signal means furnishing a switching signal when said feed means is switched off;

a microprocessor having a first input connected to said output of said first signal decoupler having a low trigger threshold and having a second input connected to said output of said second signal decoupler having a high trigger threshold, said microprocessor having a third input connected to said signal means, said microprocessor having a first output connected to said drive aggregate and having a second output connected to said switch, wherein said microprocessor is programmed with a program to switch on said drive aggregate to sense the movement of said second comminution tool toward said first rotating comminution tool upon receiving a time-delay signal derived by said signal means which indicates that said feed means is switched off, wherein said microprocessor reverses a direction of motion for moving said second comminution tool away from said first comminution tool as soon as a second signal reaches said microprocessor wherein said second signal surpasses said high trigger threshold in a certain amount and wherein said second signal is of a longer time duration, wherein said microprocessor stops the movement of said second comminution tool away from said first comminution tool based on the program entered into said microprocessor, and said microprocessor reinitiates the feeding of material into said impact mill by sending a corresponding signal to said switch.

41. The comminuting machine according to claim 40 further comprising a first time delay circuit having an input connected to said first signal decoupler having said low trigger threshold and having said output connected to said first input of said microprocessor for delivering a first trigger signal after a frist delay time;

a second time delay circuit having an input connected to said second signal decoupler having said high trigger threshold and having said output connected to said second input of said microprocessor for delivering a second trigger signal after a second delay time.

42. An impact mill for automatically adjusting an impact plate comprising a casing of the impact mill;

a rotor;

an impact plate;

a drive aggregate attached to said impact plate for adjusting the position of said impact plate relative to an impact circle of said rotor;

a control switch associated with said drive aggregate for controlling the operation of said drive aggregate;

a microphone having an output and disposed in the casing of the impact mill;

an amplifier having an output and an input connected to said output of said microphone;

a first signal decoupler with a low trigger threshold having an ouput and an input connected to said output of the amplifier;

a second signal decoupler with a high trigger threshold having an output and an input connected to said output of said amplifier, whereby an amplified signal, coming from said microphone is subdivided into two channels with a first channel formed by said first signal decoupler with said low trigger threshold, and with a second channel formed by said second signal decoupler with said high trigger threshold;

feed means for feeding material into said impact mill;

signal means associated with said feed means for indicating if said feed means is in an on or off state;

a microprocessor having a first input connected to said ouput of said first signal decoupler having said low trigger threshold, and a second input connected to said output of said second signal decoupler having said high trigger threshold, said microprocessor having a third input connected to said signal means and said microprocessor having a first output connected to said control switch and a second output connected to said feed means, wherein said microprocessor is programmed with a program to receive a time-delay signal derived from said signal means indicating a switching off of the material feed, said microprocessor switches on said drive aggregate when said sense of the impact plate moves toward said impact circle of said rotor, said microprocessor initiates the switch when said sense of said impact plate moves away from said impact circle of said rotor as soon as a signal is derived from said microphone that reaches said microprocessor in a repeated successive sequence, and said signal surpasses said high trigger threshold, wherein said microprocessor stops the motion when said said impact plate moves away from said impact circle of said rotor based on said program entered into said microprocessor, and wherein said microprocessor reinitiates the material feed-in by sending a corresponding signal to said feed means.

43. The impact mill according to claim 42 further comprising a first time delay circuit having an input connected to said first signal decoupler having said low trigger threshold and having said output connected to said first input of said microprocessor for delivering a first trigger signal after a first delay time;

a second time delay circuit having an input connected to said second signal decoupler having said high trigger threshold and having said output connected to said second input of said microprocessor for delivering a second trigger signal after a second delay time.

44. The impact mill according to claim 42 further comprising an elastic intermediate member having a first part and a second part and disposed between said drive aggregate and said second comminuting tool, wherein said first part and said second part are movable relative to each other;

a switching element connected to said microprocessor and furnished at said first part and at said second part of said elastic intermediate member which are movable relative to each other, wherein said switching element changes its switching state from the drive side upon comprising at said intermediate member and to generates said second signal fed in to said microprocessor, whereupon said microprocessor stops the motion of said impact plate toward said impact circle of said rotor and wherein said microprocessor modifies the drive motion of said impact plate until a point in time where said switching state upon compression of said switching element no longer exists.

45. The impact mill according to claim 42 further comprising a reversible electric motor;

a worm drive gear connected to said reversible electric motor;

a spindle disposed substantially radially of said rotor and driven by the worm drive gear;

an elastic cushion;

a lug connecting said elastic cushion to said second comminuting tool.

* * * * *

UNITED STATES PATENT AND TRADEMARK OFFICE

CERTIFICATE OF CORRECTION

PATENT NO. : 5,226,604

DATED : July 13, 1993

INVENTOR(S) : Klaus-Peter Seiffert et al

It is certified that error appears in the above-indentified patent and that said Letters Patent is hereby corrected as shown below:

On the title page item [75], delete "Hiep P. Hung" and insert --Hiep Phan Hung--

Signed and Sealed this

Twenty-first Day of February, 1995

*Attest:*

Bruce Lehman

BRUCE LEHMAN

*Attesting Officer*

*Commissioner of Patents and Trademarks*